US007404690B2

(12) United States Patent
Lukasik et al.

(10) Patent No.: US 7,404,690 B2
(45) Date of Patent: Jul. 29, 2008

(54) TEMPORARY ROAD ELEMENT

(75) Inventors: Marck Lukasik, Edmonton (CA); Alan Champagne, Legal (CA); Marc Poul Joseph Breault, St. Albert (CA); Andre Octave Joseph Breault, St. Albert (CA)

(73) Assignee: Champagne Edition, Inc., Legal, Alberta (CA)

( * ) Notice: Subject to any disclaimer, the term of this patent is extended or adjusted under 35 U.S.C. 154(b) by 276 days.

(21) Appl. No.: 11/393,802

(22) Filed: Mar. 31, 2006

(65) Prior Publication Data

US 2007/0237581 A1 Oct. 11, 2007

(51) Int. Cl.
*E01C 9/08* (2006.01)
*E01C 5/18* (2006.01)
*E01C 5/22* (2006.01)

(52) U.S. Cl. ..... 404/36; 404/29; 404/32; 404/34; 404/35; 404/46; 52/649.1

(58) Field of Classification Search ..... 404/29, 404/32, 34–36, 46; 52/600–602, 649.1
See application file for complete search history.

(56) References Cited

U.S. PATENT DOCUMENTS

| | | | | |
|---|---|---|---|---|
| 4,408,365 | A | 10/1983 | Palmer | |
| 4,465,720 | A | 8/1984 | Bell et al. | |
| 4,600,337 | A | 7/1986 | Sarver | |
| 4,850,738 | A | 7/1989 | Niemi | |
| 6,048,129 | A | 4/2000 | Rue | |
| 6,874,972 | B2 | 4/2005 | Davis et al. | |
| 6,921,229 | B2 | 7/2005 | Klyne | |
| 6,962,464 | B1 * | 11/2005 | Chen | 405/43 |
| 2001/0010140 | A1 * | 8/2001 | Ritter et al. | 52/649.1 |

FOREIGN PATENT DOCUMENTS

| | | | |
|---|---|---|---|
| CA | 2 473 000 | A1 | 12/2005 |
| CA | 2473000 | | 12/2005 |
| CH | 601 567 | A5 | 7/1978 |
| JP | 2000273809 | A | 3/2000 |
| KR | 1020020090974 | A | 12/2002 |

OTHER PUBLICATIONS

Daniel Rempel, International Search Report, May 5, 2007 International Searching Authority.

* cited by examiner

*Primary Examiner*—Raymond W Addie
(74) *Attorney, Agent, or Firm*—Terry M Gernstein

(57) ABSTRACT

A road element is formed of a one-piece cage that includes two layers of orthogonally arranged rebars which are welded together. The layers are connected by connecting rebars that are welded to the rebars of the layers at the intersections and the one-piece cage is encased in a flexible material formed of crumb rubber, urethane, and fibers from land vehicle tires. Plates can be included with the one-piece cage to further enhance the strength of the element.

10 Claims, 4 Drawing Sheets

TEMPORARY ROAD ELEMENT

TECHNICAL FIELD OF THE INVENTION

The present invention relates to the general art of roads and roadways, and to the particular field of load-supporting surfaces used as a temporary road or temporary road bed.

BACKGROUND OF THE INVENTION

Many work sites, such as construction sites, mining sites, farming, logging, gas and oil drilling sites, as well as others, often occur in areas where there is no prepared road bed. It is customary in the oilfield industry to have the requirement of transporting heavy machinery on trucks to remote areas in fields and the like where there is no prepared roadbed. Such areas may be on soft ground, mud, swam, wetlands, tundra, muskeg, sand, or the like. Often these roads are located in areas that are subject to extreme temperature ranges and must be left unattended for great lengths of time. Accordingly, these roads are subject to extreme conditions.

The axle loading of a typical heavy equipment truck is such that it is not feasible to drive it across a scraped or unprepared ground surface without experiencing sinking, jamming of the truck, and similar impediments. Accordingly, heavy equipment used at the work site requires a suitable road bed that is stable to prevent the equipment from becoming stuck in the soft ground. These vehicle also require a road that is fairly smooth. However, the nature of the industries causes the roads to traverse extremely rugged and uneven terrain. Accordingly, there are at least two competing interests in these roads: requirements for a stable and smooth surface, which must be considered against the constraints associated with uneven and unstable terrain. Exacerbating the problem is the fact that many of the roads, once constructed, will remain unattended and unrepaired for great lengths of time. Heretofore known roads have been deficient in balancing these competing objectives and the constraints placed on the roads.

Furthermore, there are frequently regulations associated with performing work in environmentally sensitive areas, which require the site to be returned to its original pristine condition when work is completed. Such site restoration can become quite expensive and labor intensive. Accordingly, while the art has been concerned with ground surfaces incapable of supporting the weight of a motor vehicle, there is now a further need to protect environmentally sensitive areas in order to reduce environmental damage.

A common practice for many years has been to construct a temporary road bed from wood planks that are laid on the ground and nailed together. Typically, a second and third layer of wood planks are laid on top of the base layer in alternating directions and secured together by nails. The number of layers of wood planks can vary depending on the stability of the ground and the weight of the equipment that will travel over the road as well as the environmental conditions surrounding the road. Various methods have been proposed to form a temporary road bed using preassembled mats constructed from wood boards. These mats typically include a structure for interlocking with an adjacent mat. These preconstructed mats are generally intended to be reusable by disassembling the road bed and transporting the mats to a new location.

Construction of a temporary road bed using individual boards is costly and labor intensive. The heavy equipment that travels over the road bed often damages a large number of the boards so that the boards cannot be reused. Disassembly of the road bed is also labor intensive and damages many of the boards not previously damaged during use. As a result, a significant portion of the boards used to construct the road bed are discarded. Still further roads formed of wood are subject to degrading, separation and the like. If nails are used to connect boards, these nails can become dislodged and may damage the tires of vehicles traversing the road. If the nails become dislodged, the boards can become separated which can damage the tires of vehicles traversing the road or even producing slick spots. Still further, if the wood becomes damaged or nails fall out, elements of the road may remain after the road is removed thereby causing undesirable environmental damage. If the boards become separated, vehicles may cause damage to the ground in the open areas, again causing undesired environmental damage.

Therefore, temporary roadways formed of wood have many undesirable characteristics.

Numerous examples of preconstructed mats for use in constructing a temporary road bed or flooring system are known. However, the prior methods of constructing a temporary road bed are generally expensive and time consuming. Although the preconstructed mats can reduce the time for constructing a temporary road, the cost of manufacturing the mats and the difficulty of moving and assembling the mats have limited their use.

In view of the deficiencies of the prior methods and devices, a continuing need exists in the industry for an improved method and device for constructing a temporary road bed.

This need has been approached by several methods. For example, the inventor is aware of several methods and devices for forming a temporary road bed from elements other than wood, such as rubber from discarded tires. However, the heretofore proposed methods of forming construction mats from discarded tires required the components parts of the individual tires to be separated from the tire, that is, the separation of the tire tread section from the tire sidewall section. These methods also required the individual tire segments so separated to be fixed or arrayed in a uniform or consistent manner before being linked together to form a mat. These steps in the prior methods are expensive and time consuming. Other known methods are also time consuming and labor intensive.

Still further, these known methods do not produce a mat that is stable and which has a good memory so it will return to its initial condition after supporting a very heavy load, even a load as high as thousands of tons which is common in the construction and oil drilling industry and even if the road is located in an area that is subject to extreme environmental conditions and which may be left unattended for great lengths of time. Heretofore known mats are quite likely to become damaged and permanently distorted by such heavy loads and conditions. A damaged or distorted mat must be replaced, which can add expense to the overall job through the cost of materials as well as the cost of labor, which is doubled because the damaged or distorted mat must be removed and then replaced. An unreplaced damaged road may create a hazard to vehicles and to the environment.

Consequently, a need exists for improved pavement mat as well as for improved methods in making the mat that will allow the formation of pavement mats from discarded tires in less expensive and time consuming manner and that allows for the use of discarded tires as a mat component without requiring the separation of the component parts of the tire during the mat assembly process.

There is a further need for an improved mat which will be very stable and not likely to become permanently distorted by a heavy load.

OBJECTIVES OF THE INVENTION

It is a main objective of the present invention to provide a road mat element that is stable, secure and long lasting.

It is another objective of the present invention to provide a road mat element that if flexible to allow the mat to properly conform to any supporting surface on which it is placed, even if extremely heavy traffic will traverse the element.

It is another objective of the present invention to provide a road mat element that is extremely durable.

It is another objective of the present invention to provide a road mat element that is easy to clean.

It is another objective of the present invention to provide a road mat element that provide excellent traction to vehicular traffic using the mat element.

It is another objective of the present invention to provide a road mat element that has excellent shape memory, even if traversed by extremely heavy traffic.

It is another objective of the present invention to provide a road mat element that is unaffected by extreme temperature conditions.

It is another objective of the present invention to provide a road mat element that is environmentally friendly.

SUMMARY OF THE INVENTION

The above-discussed disadvantages of the prior art are overcome by a mat which comprises a one-piece frame that includes two layers of rebars which are interconnected with rebars, with each layer including a plurality of orthogonally arranged rebars. The frame is covered with a flexible mat formed of a specialy formed composition of tire rubber, urethane, tire fibers. One form of the mat further includes rebar cage sections in the one-piece frame. It is here noted that the term "rebar" is taken in the meaning given to it in the art, such as the concrete reinforcement art in which a "rebar" is a steel reinforcement bar that can be as large as ¾" or even larger.

Using the mat embodying the present invention will permit efficient placement of temporary roadways, temporary road coverings and the like which will be stable and long-lasting even under heavy loading and soft, pliable ground conditions and extreme weather conditions. The roadway will be secure and will not require a great deal of maintenance and will still provide secure traction to vehicles yet will be easy to place and remove with little, or no, disturbance to the environment.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Referring to the figures, it can be understood that the present invention is embodied in a temporary road element 10 that achieves the above-stated objectives.

Element 10 comprises a one-piece cage 12. Cage 12 is described herein as being "one-piece" in that it is monolithic and is formed to be a one-piece element as opposed to a plurality of connected parts. Being one-piece, cage 12 has excellent strength characteristics which can withstand thousands of tons of load without permanently deforming, has good temperature resistance even when subjected to extreme temperature conditions, such as might occur in the arctic or the like, yet is flexible enough to conform to extremely uneven terrain in a manner that will properly support heavy vehicular traffic. The one-piece feature of mat 10 also makes that mat durable so that it can be left unattended for great lengths of time.

Figure 2:
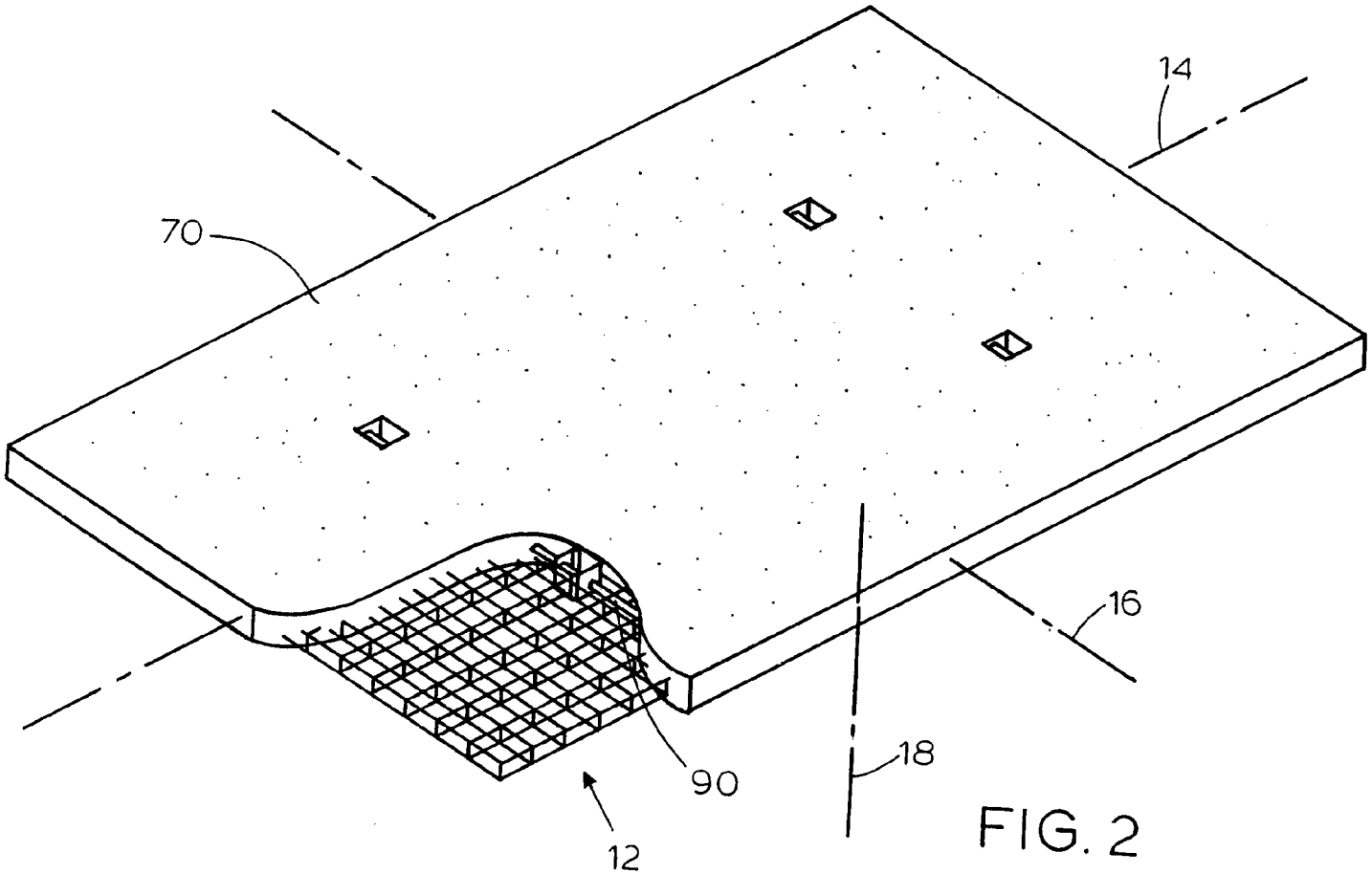
FIG. 2 is a perspective view which is partially cutaway to show the one-piece cage included with the mat embodying the present invention.
Figure 3:
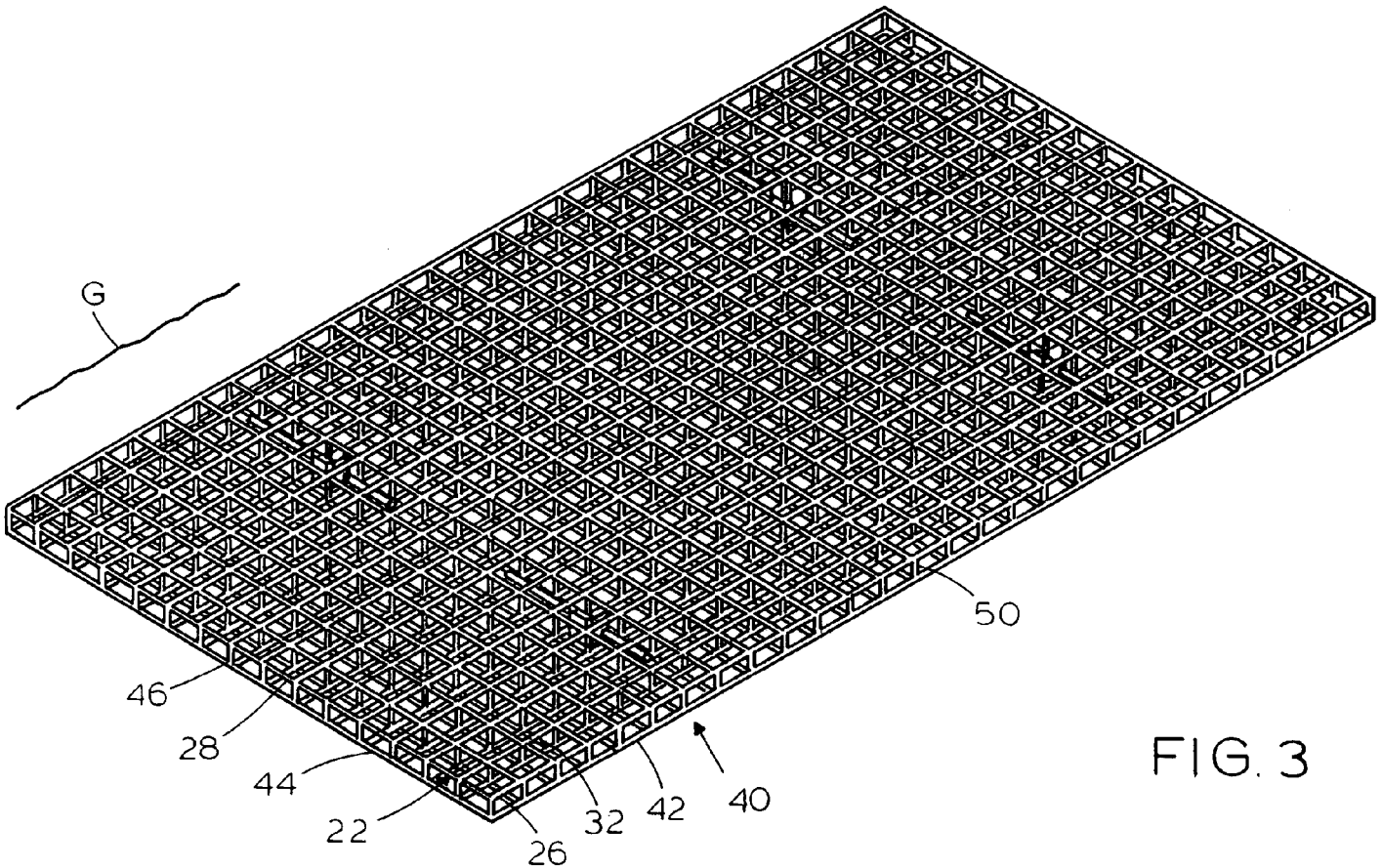
FIG. 3 is a perspective view showing the one-piece cage included with the mat embodying the present invention.
Figure 4:
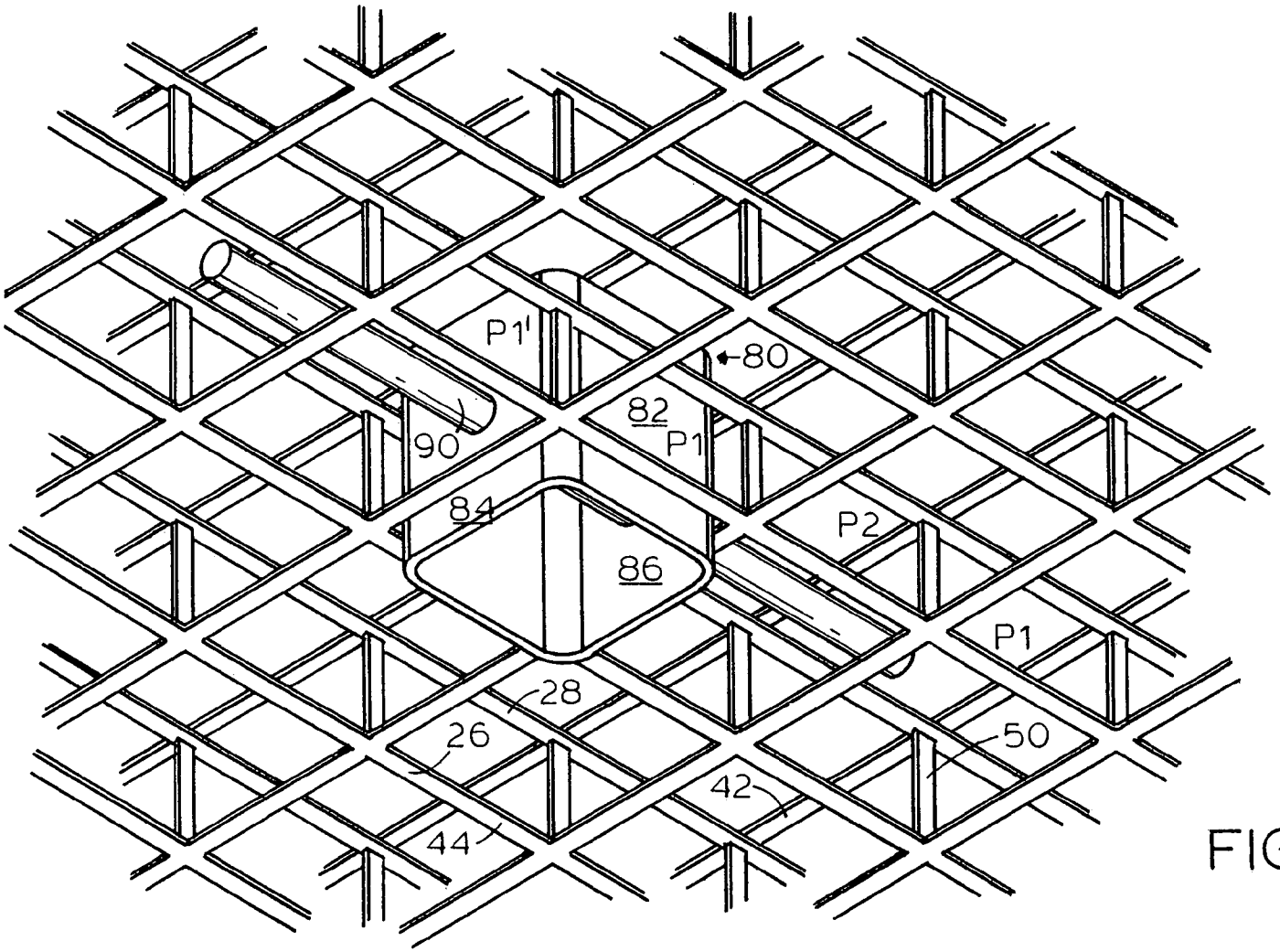
FIG. 4 is an enlarged section of the one-piece cage included with the mat embodying the present invention.

One-piece cage 12 is best shown in FIGS. 2-4 and includes a longitudinal axis 14, a transverse axis 16 and a thickness axis 18.

Cage 12 has a first section 22 which has a plurality of first rebars, such as first rebar 26, which extend in the direction of the longitudinal axis and which are spaced apart from each other in the direction of the transverse axis.

A plurality of second rebars, such as second rebar 28, extend in the direction of the transverse axis and are spaced apart from each other in the direction of the longitudinal axis. The first and second rebars intersect each other at first intersections, such as intersection 32, and are orthogonally oriented with respect to each other.

One-piece cage 12 further includes a second section 40 which is identical to the first section and thus has a plurality of third rebars, such as third rebar 42, which extend in the direction of the longitudinal axis and which are spaced apart from each other in the direction of the transverse axis. Second section 40 further includes a plurality of fourth rebars, such as fourth rebar 44, which extend in the direction of the transverse axis and which are spaced apart from each other in the direction of the longitudinal axis.

The third and fourth rebars intersect each other at second intersections, such as second intersection 46, and are orthogonally oriented with respect to each other.

The first and second sections are set up so the first rebars are co-planar with corresponding third rebars. Thus, as can be understood from FIG. 4, first and third rebars 26 and 42 define a plane $P_1$ and second and fourth rebars 28 and 44 define a plane $P_2$ which is perpendicular to plane $P_1$.

A plurality of connecting rebars, such as connecting rebar 50, which connect the intersections of the first and second rebars to corresponding intersections of the third and fourth rebars. The connecting rebars provide strength and stability to the one-piece cage. In a use orientation such as shown in FIG. 3, with second section 40 located adjacent to a supporting surface, such as the ground G, first section 22 is positioned above second section 40 and connecting rebars 50 are oriented in an upright orientation.

The intersections of the rebars are all welded to so the rebars define the one-piece structure.

Mat 10 further comprises a flexible mat 70 which provides good traction and is easy to clean. Mat 70 comprises crumb rubber, urethane and fiber from motor vehicle tires.

As can be understood from the figures, mat 70 encases the one-piece cage. The mat is easy to form and is easy form and is not subject to degradation due to extreme weather conditions. The cage 12 is one piece and is formed of large diameter rebars and thus will not tear or damage the rubber in the mat due to their size and the one-piece nature of the construction. The connecting rebars 50 especially contribute to this feature. The cage further reinforces the mat while re-directing stresses and strains so the rubber is not damaged.

Figure 1:
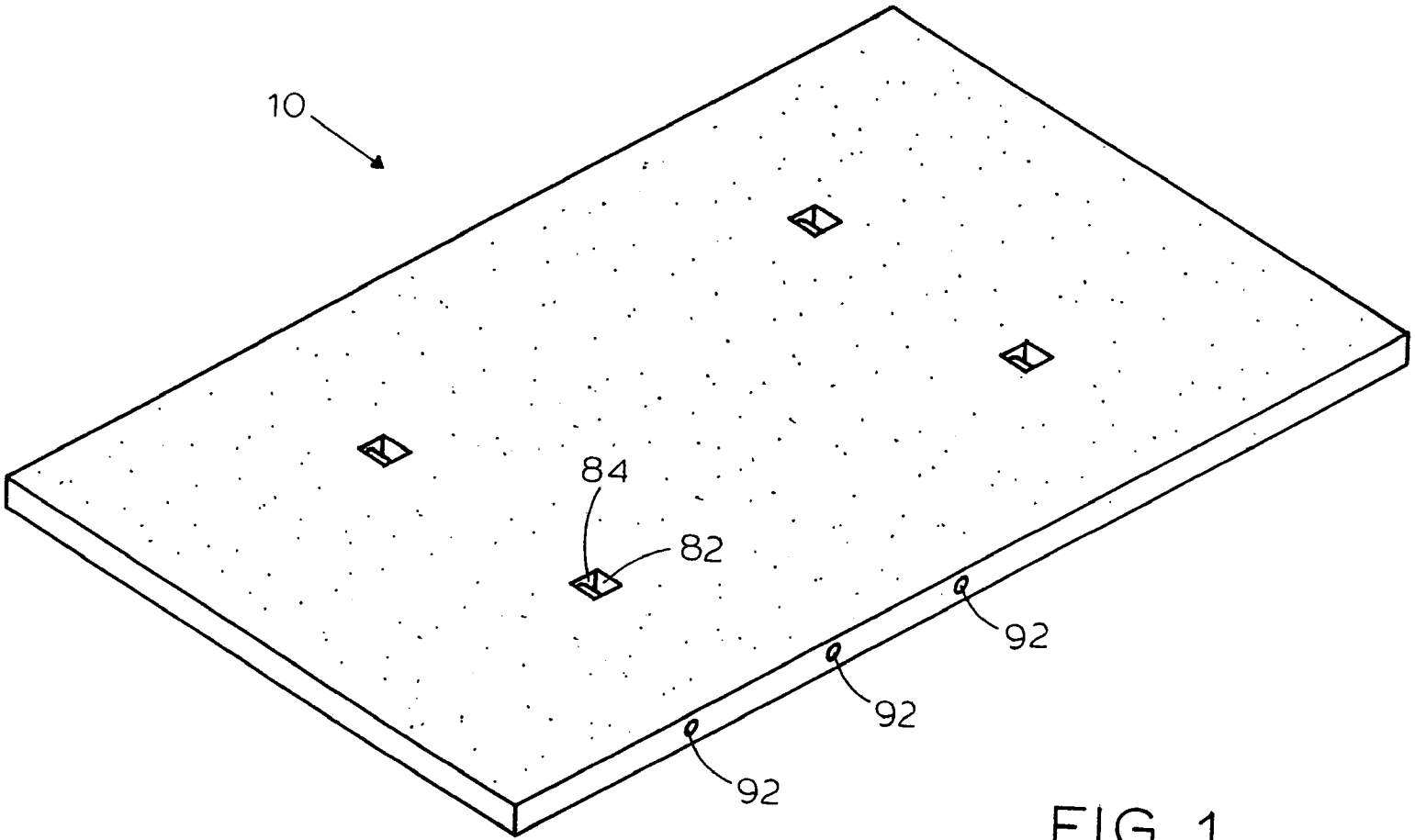
FIG. 1 is a perspective view of a mat which can be used as a temporary road or a temporary road bed embodying the present invention.

In the form of the invention shown in FIG. 4, the one piece cage element further includes an internal supporting cage 80 to further reinforce cage 12. Cage 80 is one-piece with the remainder of cage 12 and includes a first plate 82 that one-piece with one rebar of the first rebars and with one rebar of the third rebars and is thus located in plane $P_1$, a second plate 84 that is one-piece with one rebar of the second rebars and with one rebar of the fourth rebars and is in a plane $P_1'$ that is perpendicular to plane $P_1$ and a third plate 86 that is one-piece with the one rebar of the third rebars and with the one rebar of the fourth rebars. As can be understood from FIG. 1, there are a plurality of cages 80 in element 10. Cage 80 adds still further strength to element 10 and can also be used to support posts or other such elements associated with a road if desired and suitable.

Element 10 is easy to manufacture and thus will be easy, efficient and economical to install, repair, and remove. Element 10 is manufactured according to the following process: forming the one-piece cage 12; forming flexible mat 70 by providing a mold, forming a mixture of crumb rubber, urethane and fibers from land vehicle tires, pouring part of the mixture into the mold, placing the one-piece cage on the mixture, pouring in another part of the mixture onto the cage and encasing the cage in the mixture, applying pressure to the mixture covered cage, and cold curing the mixture covered cage.

In the form shown in FIG. 4, a conduit 90 can be included if desired. Conduit 90 extends in the direction of transverse axis 16 and is welded to the rebars to be part of the one-piece nature of the cage. Conduits 90 can be drainage conduits if desired, or they can extend out of the element and be accommodated in corresponding bores, such as conduits 92, defined in an adjacent element to couple the elements together. Conduits 92 are also welded to the cage of the associated element and are slightly larger than conduits 90 whereby conduits 90 can be slidingly accommodated in conduits 92 to couple adjacent elements together.

Use of element 10 can be understood from the teaching of the foregoing disclosure and thus will be only briefly discussed. One or more elements 10 are formed according to the above-described process, and are placed on terrain over which vehicles will traverse. The conduits can be connected together to securely couple adjacent elements together. Vehicular traffic can then be accommodated on the coupled elements.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A temporary road element comprising:

A) one-piece cage which includes (1) a longitudinal axis, (2) a transverse axis, (3) a thickness axis, (4) a first section having (a) a plurality of first rebars which extend in the direction of the longitudinal axis and which are spaced apart from each other in the direction of the transverse axis, and (b) a plurality of second rebars which extend in the direction of the transverse axis and which are spaced apart from each other in the direction of the longitudinal axis, and (c) the first and second rebars intersecting each other at first intersections and being orthogonally oriented with respect to each other, (5) a second section having (a) a plurality of third rebars which extend in the direction of the longitudinal axis and which are spaced apart from each other in the direction of the transverse axis, and (b) a plurality of fourth rebars which extend in the direction of the transverse axis and which are spaced apart from each other in the direction of the longitudinal axis, and (c) the third and fourth rebars intersecting each other at second intersections and being orthogonally oriented with respect to each other, (6) the first rebars being co-planar with corresponding third rebars, (7) the second rebars being co-planar with corresponding fourth rebars, (8) a plurality of connecting rebars which connect the intersections of the first and second rebars to corresponding intersections of the third and fourth rebars, and (9) the intersections of the rebars all being welded together so the rebars define a one-piece structure;

B) a flexible mat which comprises (1) crumb rubber, (2) urethane, and (3) fiber from motor vehicle tires; and C) the flexible mat encasing the one-piece cage.

2. The temporary road element defined in claim 1 wherein the one-piece cage further includes a first plate that one-piece with one rebar of the first rebars and with one rebar of the third rebars, a second plate that is one-piece with one rebar of the second rebars and with one rebar of the fourth rebars and a third plate that is one-piece with the one rebar of the third rebars and with the one rebar of the fourth rebars.

3. The temporary road element defined in claim 1 further including a conduit which is located between the first section and the second section and which extends in the direction of the transverse axis of the one-piece cage.

4. The temporary road element defined in claim 1 wherein the flexible mat is formed by cold curing and including crumb rubber, urethane and fiber from land vehicle tires.

5. The temporary road element defined in claim 1 wherein the flexible mat is formed by a cold curing process.

6. The temporary road element defined in claim 1 wherein the flexible mat is formed by a process which includes steps comprising providing a mold, forming a mixture of crumb rubber, urethane and fibers from land vehicle tires, applying pressure to the mixture, and cold curing the mixture.

7. A temporary road element comprising:

A) a one-piece cage which includes first and second layers of orthogonally arranged rebars and a plurality of connecting rebars which connect rebars of the first layer to rebars of the second layer; and B) a flexible mat which encases the one-piece cage, the flexible mat being flexible mat is formed by a process which includes steps comprising providing a mold, forming a mixture of crumb rubber, urethane and fibers from land vehicle tires, applying pressure to the mixture, and cold curing the mixture.

8. The temporary road element defined in claim 7 further including a plurality of plates which are one-piece with one rebar in the first layer and one rebar in the second layer.

9. The temporary road element defined in claim 8 further including another plate which is one piece with two rebars in the second layer.

10. A temporary road element formed by a process which comprises:

A) forming a one-piece cage which includes a longitudinal axis, a transverse axis, a thickness axis, a first section having a plurality of first rebars which extend in the direction of the longitudinal axis and which are spaced apart from each other in the direction of the transverse axis, and a plurality of second rebars which extend in the direction of the transverse axis and which are spaced apart from each other in the direction of the longitudinal axis, and the first and second rebars intersecting each other at first intersections and being orthogonally oriented with respect to each other, a second section having a plurality of third rebars which extend in the direction of the longitudinal axis and which are spaced apart from each other in the direction of the transverse axis, and a plurality of fourth rebars which extend in the direction of the transverse axis and which are spaced apart from each other in the direction of the longitudinal axis, and the third and fourth rebars intersecting each other at second intersections and being orthogonally oriented with respect to each other, the first rebars being co-planar with corresponding third rebars, the second rebars being co-planar with corresponding fourth rebars, a plurality of connecting rebars which connect the intersections of the first and second rebars to corresponding intersections of the third and fourth rebars, and the intersections of the rebars all being welded to so the rebars define a one-piece structure; and B) forming a flexible mat by providing a mold, forming a mixture of crumb rubber, urethane and fibers from land vehicle tires, pouring part of the mixture into the mold, placing the one-piece cage on the mixture, pouring in another part of the mixture onto the cage and encasing the cage in the mixture, applying pressure to the mixture covered cage, and cold curing the mixture covered cage.

* * * * *

UNITED STATES PATENT AND TRADEMARK OFFICE

CERTIFICATE OF CORRECTION

PATENT NO. : 7,404,690 B2
APPLICATION NO. : 11/393802
DATED : July 29, 2008
INVENTOR(S) : Mark Lukasik et al.

It is certified that error appears in the above-identified patent and that said Letters Patent is hereby corrected as shown below:

On the title page, item [75] 1st inventor should read:
--Inventors: Mark Lukasik--.

Signed and Sealed this

Fourteenth Day of October, 2008

JON W. DUDAS
*Director of the United States Patent and Trademark Office*